US006505572B1

(12) United States Patent
Seipel et al.

(10) Patent No.: US 6,505,572 B1
(45) Date of Patent: Jan. 14, 2003

(54) BALLAST BOAT CHAIR FOR WAKE ENHANCEMENT

(76) Inventors: John Seipel, 307 Crescent La., Thiensville, WI (US) 53092; Mike Seipel, 520 S. Country Club Dr., Lake Worth, FL (US) 33462

( * ) Notice: Subject to any disclaimer, the term of this patent is extended or adjusted under 35 U.S.C. 154(b) by 0 days.

(21) Appl. No.: 09/698,839

(22) Filed: Oct. 27, 2000

(51) Int. Cl.[7] ..... B63B 39/03; B63B 17/00
(52) U.S. Cl. ..... 114/125; 114/363
(58) Field of Search ..... 114/125, 188, 114/363; D6/358

(56) References Cited

U.S. PATENT DOCUMENTS

| | | | | | |
|---|---|---|---|---|---|
| 4,189,181 | A | | 2/1980 | Noble et al. | 297/455 |
| 4,341,177 | A | | 7/1982 | Miyazaki et al. | 114/125 |
| 4,370,769 | A | | 2/1983 | Herzig et al. | 5/452 |
| 4,391,466 | A | | 7/1983 | Smith | 297/452 |
| 4,773,709 | A | * | 9/1988 | Slinkard | 297/193 |
| 4,929,026 | A | | 5/1990 | Barbelet | 257/454 |
| 4,932,721 | A | * | 6/1990 | Anthony | 297/452 |
| 5,050,526 | A | * | 9/1991 | Nelson et al. | 114/364 |
| D331,322 | S | * | 12/1992 | Schmitt | D6/358 |
| D340,145 | S | * | 10/1993 | Smart et al. | D6/381 |
| D374,127 | S | * | 10/1996 | Diaz | D6/358 |
| 5,787,835 | A | | 8/1998 | Remnant | 114/271 |
| 5,794,559 | A | | 8/1998 | Graham | 114/343 |
| 6,012,778 | A | | 1/2000 | Peterson | 297/452 |
| 6,044,788 | A | * | 4/2000 | Larson et al. | 114/253 |
| D439,064 | S | * | 3/2001 | Cave | D6/358 |
| 6,224,444 | B1 | * | 5/2001 | Klimenko | 441/130 |

OTHER PUBLICATIONS

"Meriam–Webster's Coolegiate Dictionary, Tenth Edition." Merrian–Webster, Inc. 1993, p. 189, 1054.*

* cited by examiner

*Primary Examiner*—S. Joseph Morano
*Assistant Examiner*—Andrew Wright
(74) *Attorney, Agent, or Firm*—Coats & Bennett, P.L.L.C.

(57) ABSTRACT

The wake behind a water vessel may be enhanced for wake boarding or water skiing by providing a fluid fillable chair in the rear of the water vessel to act as ballast so as to increase the wake of the water vessel. As the water vessel moves through the water, the towed individual experiences an increased wake, thereby improving enjoyment of the activity. In a preferred embodiment, the chair of the present invention includes a seat portion and a back portion and wherein the seat portion is adapted to be filled with a volume of water. The back may be filled with water or air. By filling at least the seat portion with water, the weight of the chair is increased such that when the chair is positioned in the rear portion of a boat, a relatively large wake may be created as the boat moves through a body of water.

29 Claims, 4 Drawing Sheets

BALLAST BOAT CHAIR FOR WAKE ENHANCEMENT

FIELD OF THE INVENTION

The present invention relates to a multi-function device and technique for increasing the wake of a water vessel so as to improve wake boarding or water skiing activity therebehind.

BACKGROUND OF THE INVENTION

Water skiing and wake boarding are popular summer time activities on many lakes, rivers, or other bodies of water. A powered motor vessel surges through the water creating a wake on which the proficient water skier or wake boarder may perform tricks or other activity. In general, the larger the wake, the more challenging and fun the activity is.

Powered water vessels typically create a wake based in large part on the displacement of water by the hull. One technique to increase the displacement of the hull is to include ballast on the powered water vessel, which causes the powered water vessel to sit lower in the water. In particular, it is often desirous to place the ballast near the rear of the vessel so as to maximize the wake created.

Numerous devices do exist which serve as ballast for water vessels, and some are particularly contemplated as being placed in the rear of the vessel to improve wake performance. An exemplary device is illustrated in U.S. Pat. No. 5,787,835.

It is common for there to be a lack of adequate seating on the vessel during use. In particular, most powered water vessels designed to pull water skiers or wake boarders are sleek vessels with a minimum of seats available for people not water skiing or wake boarding. This may be especially true at the rear of the vessel. Sometimes it is desirable to have someone watching the towed individual so as to free the driver of the vessel to pilot the vessel in a safe manner. Since seats are at a premium, this may not always be possible.

Thus, there remains a need for a ballast device that may serve as a chair for passengers in a water vessel that further provides an increase in the wake behind the vessel.

SUMMARY OF THE INVENTION

The present invention comprises an inflatable chair that may be filled with a fluid such as water to serve as ballast in the rear of a water vessel such that the wake of the water vessel is enhanced for water skiing or wake boarding purposes. The chair may be positioned so that someone looks forward, or alternately, backward so as to view the towed individual, freeing the driver to steer the vessel in a safe manner. The fluid in the chair may double as a cushioning or resilient filler material. The placement in the rear of the vessel puts the weight approximate the motor or motors and thus enhances the wake created by the vessel as it maneuvers through the water.

DETAILED DESCRIPTION OF THE INVENTION

Figure 1A:
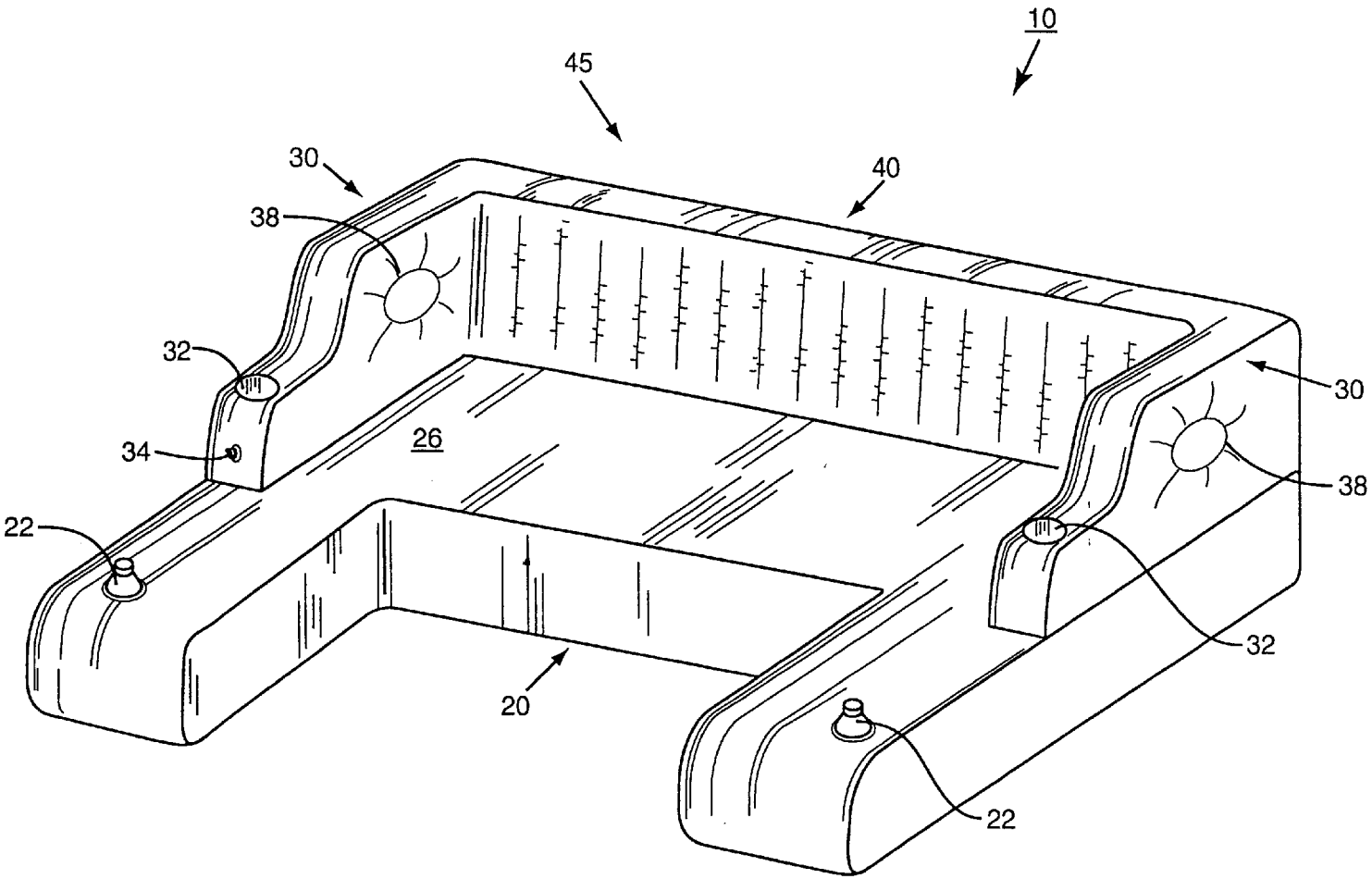
FIG. 1A illustrates one embodiment of a wake enhancing, fluid fillable chair for use with a water vessel according the present invention.
Figure 1B:
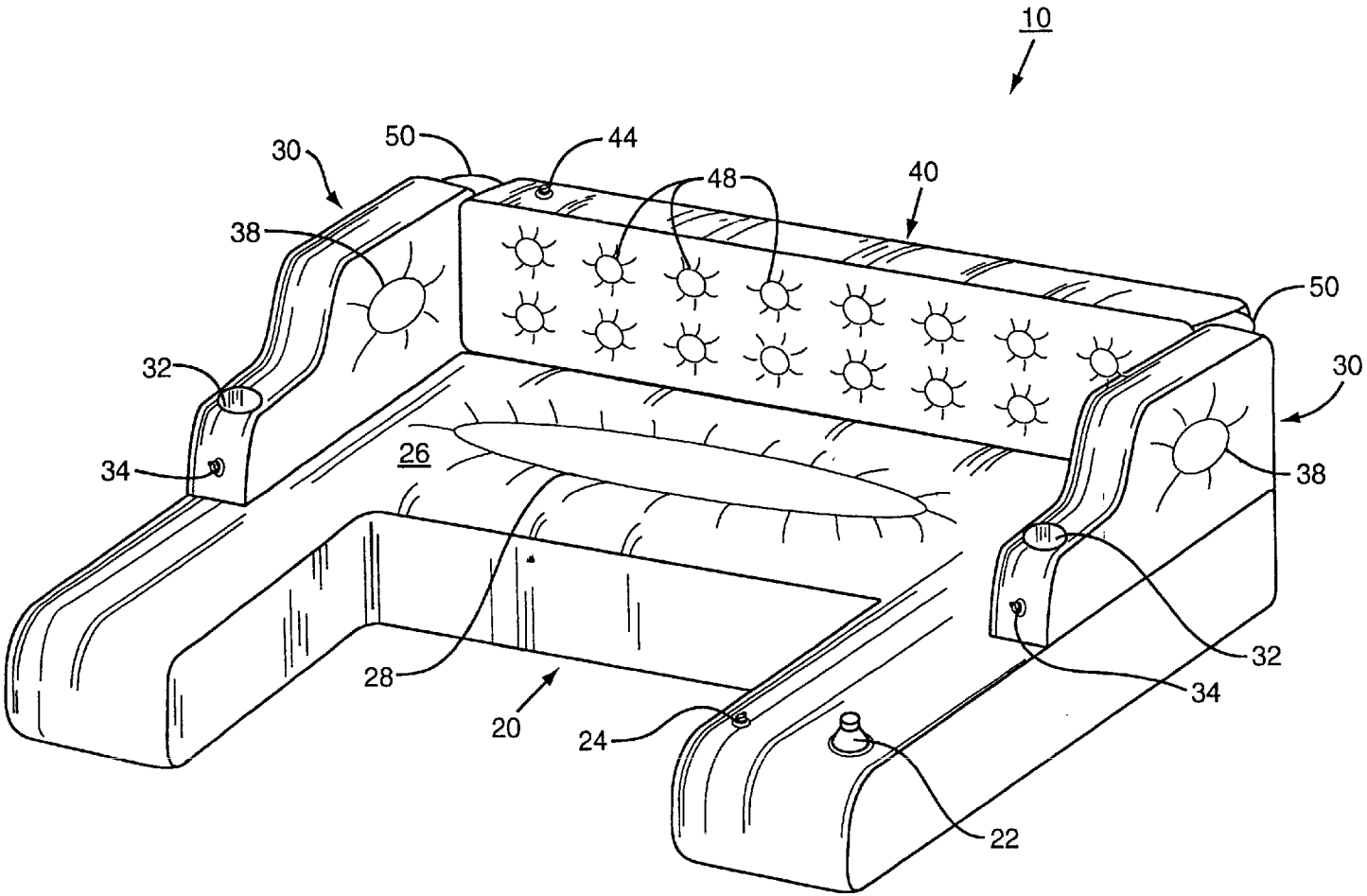
FIG. 1B illustrates an alternate embodiment of the chair of the present invention.

The present invention comprises a fluid fillable chair positioned in the rear of a water vessel to improve the wake therebehind. Turning now to the drawings, and particularly to FIGS. 1A and 1B, wherein a chair 10 according to the present invention is illustrated. Chair 10 comprises a seat 20, a pair of armrests 30, and a back 40.

Seat 20 comprises a hollow, inflatable bladder, accessed by relatively large valves 22. Herein "inflatable" means that the chair or a portion thereof is filled with a fluid such as water or a gas such as air. Large valves 22 are sized to accommodate a garden hose or other similar fluid conveying device and may comprise a screw top or other closure mechanism as is well understood. Top surface 26 is adapted for sitting thereon, and may include a plurality of corrugations 28 (FIG. 1B) such as are commonly found on pool floats. Valves 22 allow the seat 20 to be filled with a fluid or gas, thereby inflating the seat 20, and making the seat 20 weightier. However, it is contemplated that in most applications, the seat 20 will be filled with water or some other liquid. While the valves 22 are shown in one position in the accompanying figures, it should be appreciated that they may be positioned on the seat 20 during manufacturing as needed or desired. Corrugations 28 allow fluid such as water or sweat that falls upon the seat 20 to be channeled to a desired location. Corrugations 28 may also be associated with internal baffles if needed or desired.

Armrests 30 may comprise a cup holder 32, a valve 34, and a plurality of corrugations 38. Cup holder 32 comprises an indentation sized to fit a stadium cup or the like as needed or desired. While only one cup holder 32 per armrest 30 is illustrated, it should be appreciated that a plurality of cup holders 32 may be positioned in each armrest 30 as needed or desired. Corrugations 38 likewise may be associated with internal baffles as needed or desired.

Back 40 similarly may comprise corrugations 48, comparable to corrugations 28, 38. In the embodiment of FIG. 1A, armrests 30 and back 40 are an integral unit, namely upper 45 with a single valve 34 to inflate the upper 45. Valve 34 may be a small air valve with a check flap, such as are commonly found in pool floats.

In the alternate embodiment of FIG. 1B, armrests 30 and back 40 are distinct elements, each having a respective valve 34 or 44. Armrests 30 may be connected to back 40 by living hinges 50 as needed or desired. While it is expected that armrests 30, back 40 or upper 45 will be inflated with a gas such as air, it is also possible to fill these elements with a fluid such as water if desired. Likewise, it is possible to position a small valve 24 on the seat 20 if desired. In the alternate embodiment, it is possible to fill seat 20 and back 40 with water, while inflating armrests 30 with air. Alternatively, seat 20 and one armrest may be fluid filled and the rest inflated with air. Other permutations are also possible, but this versatility allows the weight of the chair 10 to be varied somewhat. While these variations may be utilized, in most applications it is contemplated that the seat 20 will be filled with water and the armrest and back will be filled with air. However, it is certainly contemplateable that the seat, armrest and back could all be filled with a liquid such as water.

Figure 2:
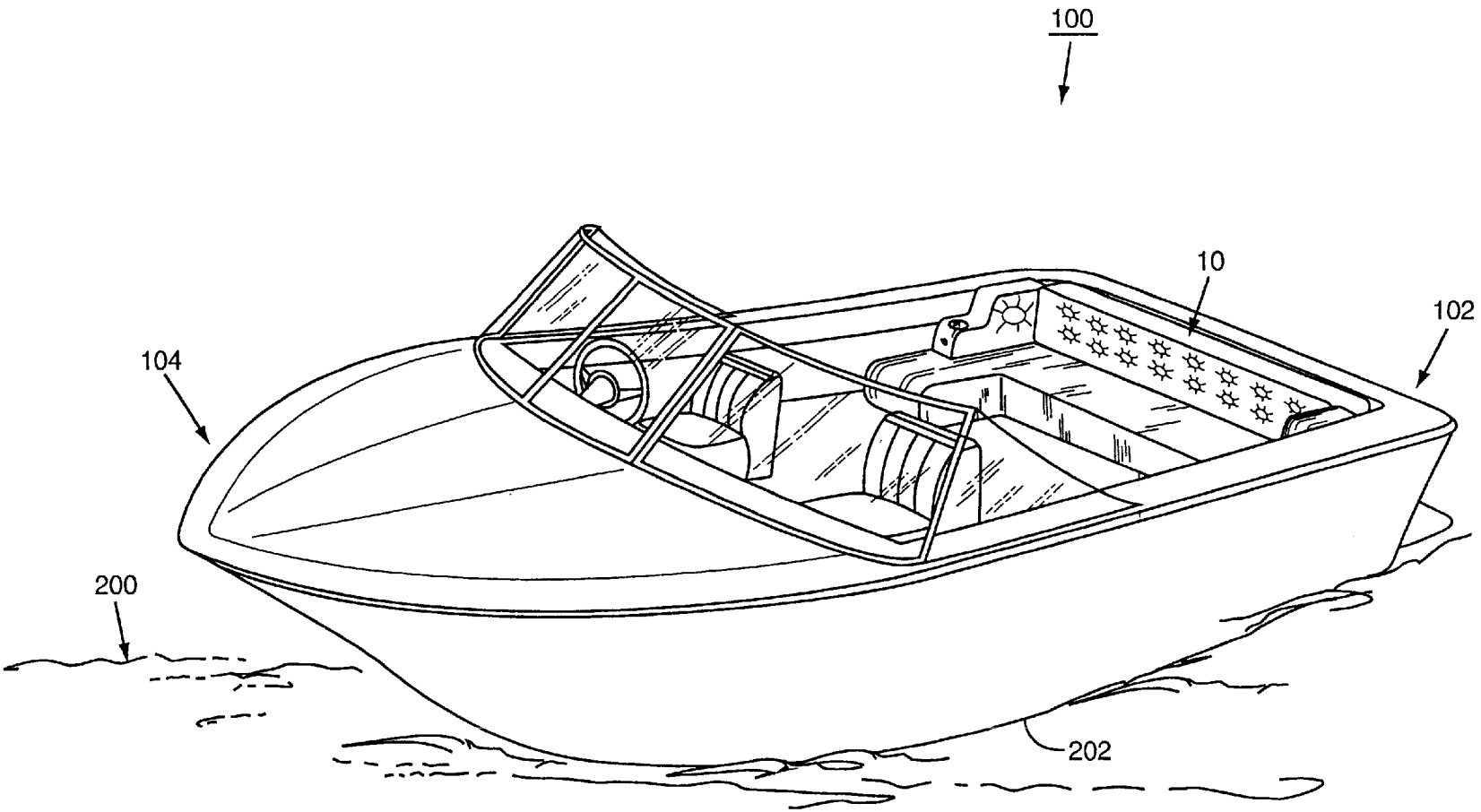
FIG. 2 illustrates the chair of FIG. 1B positioned in the rear of a water vessel.

Chair 10 may be made from a plastic or polymeric impermeable material with seat 20 attached to armrests 30 and back 40 or upper 45 by living hinges or other non-inflatable portions. In the illustrated embodiments, chair 10 accommodates two individuals thereon. In other embodiments, the number of persons able to sit thereon may be varied. For example, the chair 10 of the present invention can be designed such that it simply accommodates a single person. It should be appreciated that in a deflated state, the material of the chair 10 may be folded so as to minimize the amount of space required to house the chair 10. However, inflated, chair 10 may be heavy and is designed to add ballast to a water vessel 100 (FIG. 2).

Water vessel 100 may include a rear section 102, a front section 104 and a driver 106. Chair 10 may be positioned in the rear section 102 facing forward (as illustrated in FIG. 2) or backward (as illustrated in FIG. 4).

Figure 3:
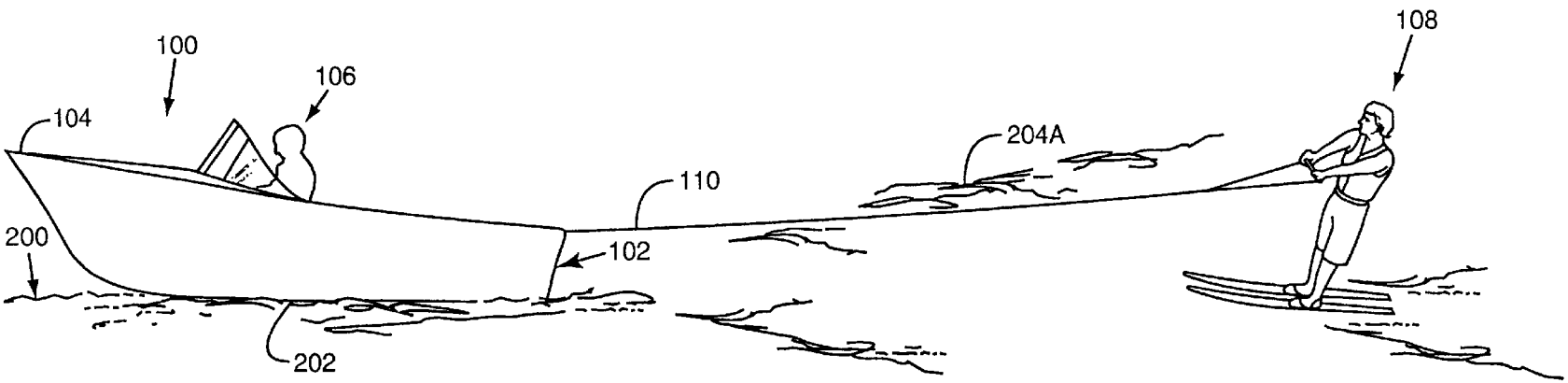
FIG. 3 PRIOR ART
FIG. 3 illustrates a water vessel without the present invention pulling a water skier.

As illustrated in FIG. 3, the water vessel 100 may tow a skier 108 via a rope 110. While not shown, skier 108 may alternatively be a wake boarder, a tuber, or other towed individual. Driver 106 steers the water vessel through the water 200. In FIG. 3, no chair 10 is present in water vessel 100 and water vessel 100 sits normally, having water line 202. Additionally, a normal wake 204A is created.

Figure 4:
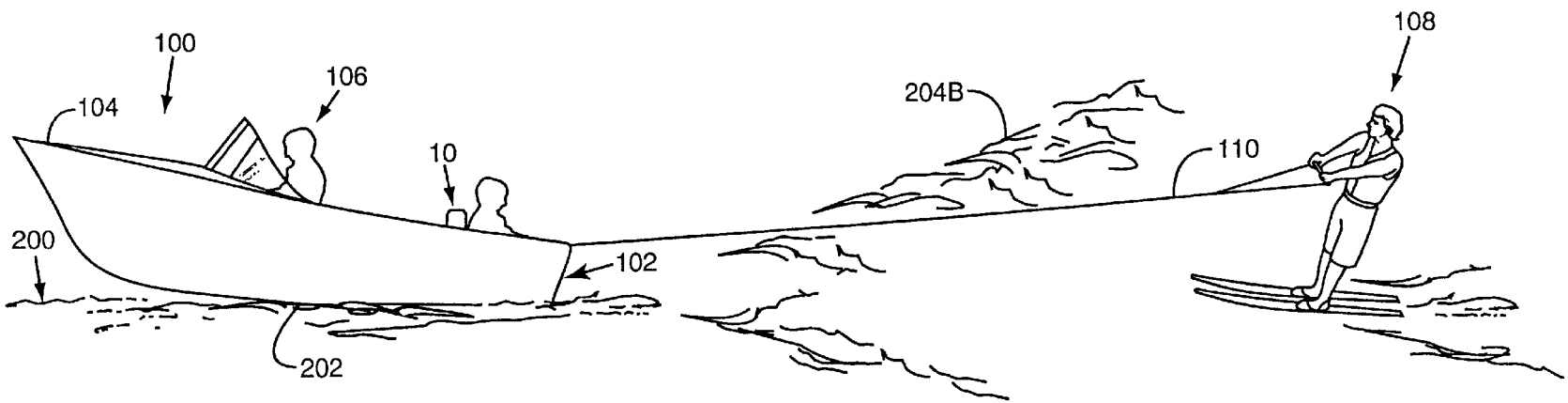
FIG. 4 illustrates a water vessel with the present invention pulling a water skier.

In contrast, in FIG. 4, the water vessel 100 has chair 10 positioned and facing rearwardly. Alternatively, chair 10 may be forwardly facing (FIG. 2). An individual may sit upon chair 10 providing further ballast to the rear section 102. Water vessel 100 now sits differently in water 200, having more of the water vessel 100 below the water line 202 in the rear section 102 and more above the water line 202 in the front section 104. This creates a larger wake 204B creating a more exciting towed activity for the skier 108, an equivalent wake boarder, tuber, or other towed individual.

It should be appreciated that it may be easiest to place the chair 10 in the water vessel 100 and then fill the seat 20 with a fluid such as water after positioning. This is not a requirement. Chair 10 may be filled with the ballast inducing fluid prior to positioning. This just makes the chair 10 heavier and more difficult to transport. Furthermore, there may be occasions when a water vessel 100 is equipped with seats or chairs in the rear portion 102 of the water vessel 100. However, these chairs or seats may not provide the desired ballast for the water vessel 100. To that end, those seats or chairs may be removed and replaced with the chair 10 of the present invention that has a variable ballast capability to create the desired wake 204B.

The terms "larger wake" or "enhanced wake" are used herein to describe a wake produced by a boat having the chair 10 of the present invention positioned therein, as contrasted to a wake produced by a boat that does not include such a chair or any other added weight to the rear portion of the boat.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. In combination, a water vessel and a chair, said water vessel comprising a front portion and a rear portion and adapted to maneuver through water while towing an individual;

said chair comprising a fluid fillable portion positioned in said rear portion of said water vessel, thereby providing ballast to the water vessel so as to enhance a wake created by the water vessel; and wherein said chair comprises a seat, a back and a pair of arm rests, said back and said pair of arm rests secured to said seat.

2. The combination of claim 1 wherein said chair is at least partially filled with water.

3. The combination of claim 2 wherein each of said pair of armrests comprises a cup holder.

4. The combination of claim 1 wherein said chair comprises a plurality of valves for introduction of fluids and gases into said chair.

5. A ballast chair for use in a water vessel to enhance a wake of the vessel, said chair comprising:

a seat having a first valve and a second valve, said first valve adapted to receive a fluid therethrough to fill said seat and increase the weight of the chair;

a back attached to said seat, said back inflatable by a fluid or a gas;

a pair of armrests, each attached to said seat and comprising a cup holder, each of said armrests being inflatable by a fluid or a gas; and said chair sized to fit in a rear section of a water vessel so as to enhance the wake behind the vessel.

6. A weighted boat seat adapted to be positioned in the rear portion of a boat for enhancing the wake produced by the boat and for providing seating within the boat, the seat comprising a bottom having an internal bladder for receiving and holding a liquid such that when filled with a liquid and positioned in the rear portion of the boat, the weight of the liquid filled seat causes the rear portion of the boat to produce an enhanced wake as the boat moves through the water and further provides seating for occupants of the boat; and wherein the chair further includes a back portion including an internal bladder for receiving and holding a fluid such as water or air.

7. The weighted boat seat of claim 6 wherein the seat portion is of a length sufficient to support at least two individuals.

8. The weighted board seat of claim 6 wherein the internal bladder of the seat is adapted to receive and hold water.

9. A combination boat and weighted seat wherein the boat includes the seat of claim 6 and wherein the weighted seat is adapted to be disposed in the rear of the boat.

10. A method of towing an individual behind a water vessel through a body of water and enhancing a wake produced by the water vessel, comprising;

positioning a chair in the rear of the water vessel filling at least a portion of the chair with fluid;

maneuvering the water vessel through the water with the chair providing ballast in a rear portion of the water vessel so as to enhance the wake produced by the water vessel; and wherein the water vessel has a seat structure in the rear portion and wherein the method further comprises removing the seat structure from the rear portion and replacing the seat structure with said chair.

11. The method of claim 10 wherein positioning a chair in the rear of the water vessel comprises positioning a forwardly facing chair in the rear of the water vessel.

12. The method of claim 10 wherein positioning a chair in the rear of the water vessel comprises positioning a rearwardly facing chair in the rear of the water vessel.

13. The method of claim 10 wherein the chair includes a seat portion and wherein the method comprises filling the seat portion with a fluid.

14. The method of claim 10 wherein filling at least a portion of the chair with a fluid comprises filling at least a portion of the chair with water.

15. The method of claim 14 wherein the chair includes a seat portion and wherein filling at least a portion of the chair with water comprises filling the seat portion with water.

16. The method of claim 10 further comprising filling a second portion of the chair with a gas.

17. The method of claim 10 further comprising sitting on the chair.

18. The method of claim 10 further comprising positioning a drink on the chair.

19. The method of claim 18 wherein positioning a drink on the chair comprises positioning a drink in a cup holder on the chair.

20. The method of claim 10 wherein positioning a chair in the rear of the water vessel comprises positioning a two person chair in the rear of the water vessel.

21. The method of claim 10 further comprising towing a water skier behind the water vessel.

22. The method of claim further comprising towing a water boarder behind the water vessel.

23. The method of claim 10 wherein the chair includes a seat portion and a back portion and wherein filling at least a portion of the chair comprises filling the seat portion with water and filling the back portion with air.

24. A method of enhancing the wake produced by a boat as the boat moves through water, comprising:

filling a seat structure with a liquid;

positioning the seat structure in the rear of the boat such that the liquid containing seat structure functions to add weight to the rear of the boat and provides a seat area for occupants within the boat to sit on;

maneuvering the boat through the water with the liquid containing seat structure providing a ballast in the rear portion of the boat and enhancing the wake produced by the boat; and wherein said seating structure includes a chair having a bottom and a back.

25. The method of claim 24 wherein one or more occupants of the boat sit on the seat structure and add additional weight to the back of the boat that further enhances the wake produced by the boat.

26. The method of claim 24 wherein the seat structure is portable and can be moced into and out of the boat.

27. The method of claim 24 including filling the seat structure with water.

28. The method of claim 24 wherein the seat structure includes two portions and wherein the method includes filling one portion of the seat structure with a liquid and filling a second portion of the seat structure with a gas.

29. The method of claim 28 wherin the portion of the seat structure filled with the liquid included a bottom portion and wherein the of the seat structure filled with a gas includes a back portion.

* * * * *